US009435016B2

(12) United States Patent
Sakurai et al.

(10) Patent No.: US 9,435,016 B2
(45) Date of Patent: Sep. 6, 2016

(54) CU-NI-SI-BASED COPPER ALLOY PLATE HAVING EXCELLENT DEEP DRAWING WORKABILITY AND METHOD OF MANUFACTURING THE SAME

(75) Inventors: Takeshi Sakurai, Aizuwakamatsu (JP); Yoshio Abe, Aizuwakamatsu (JP); Akira Saito, Aizuwakamatsu (JP); Yoshihiro Kameyama, Aizuwakamatsu (JP)

(73) Assignee: Mitsubishi Shindoh Co., Ltd., Shinagawa-ku (JP)

( * ) Notice: Subject to any disclaimer, the term of this patent is extended or adjusted under 35 U.S.C. 154(b) by 618 days.

(21) Appl. No.: 13/808,351

(22) PCT Filed: Jul. 7, 2010

(86) PCT No.: PCT/JP2010/061532

§ 371 (c)(1),
(2), (4) Date: Mar. 18, 2013

(87) PCT Pub. No.: WO2012/004868

PCT Pub. Date: Jan. 12, 2012

(65) Prior Publication Data

US 2013/0167988 A1 Jul. 4, 2013

(51) Int. Cl.
*C22F 1/08* (2006.01)
*C22C 9/06* (2006.01)
(Continued)

(52) U.S. Cl.
CPC . *C22F 1/08* (2013.01); *C22C 9/04* (2013.01); *C22C 9/06* (2013.01); *C22C 9/10* (2013.01); *C22F 1/00* (2013.01); *H01B 1/026* (2013.01)

(58) Field of Classification Search
CPC ..... C22C 9/04; C22C 9/06
See application file for complete search history.

(56) References Cited

U.S. PATENT DOCUMENTS

2002/0108685 A1 8/2002 Hatakeyama et al.
2007/0051441 A1 3/2007 Takano et al.
(Continued)

FOREIGN PATENT DOCUMENTS

JP 03-162553 A 7/1991
JP 05-279825 A 10/1993
(Continued)

OTHER PUBLICATIONS

International Search Report dated Oct. 12, 2010, issued for PCT/JP2010/061532.
(Continued)

*Primary Examiner* — Matthew E Hoban
*Assistant Examiner* — John Hevey
(74) *Attorney, Agent, or Firm* — Locke Lord LLP; James E. Armstrong, IV; Nicholas J. DiCeglie, Jr.

(57) ABSTRACT

The Cu—Ni—Si-based copper alloy plate contains 1.0 mass % to 3.0 mass % of Ni, and Si at a concentration of ⅙ to ¼ of the mass % concentration of Ni with a remainder of Cu and inevitable impurities, in which, when the average value of the aspect ratio (the minor axis of crystal grains/the major axis of crystal grains) of each crystal grains in an alloy structure is 0.4 to 0.6, the average value of GOS in the all crystal grains is 1.2° to 1.5°, and the ratio (Lσ/L) of the total special grain boundary length Lσ of special grain boundaries to the total grain boundary length L of crystal grain boundaries is 60% to 70%, the spring bending elastic limit becomes 450 N/mm$^2$ to 600 N/mm$^2$, the solder resistance to heat separation is favorable and deep drawing workability is excellent at 150° C. for 1000 hours.

3 Claims, 1 Drawing Sheet

(51) Int. Cl.

| | |
|---|---|
| ***H01B 1/02*** | (2006.01) |
| ***C22C 9/04*** | (2006.01) |
| ***C22F 1/00*** | (2006.01) |
| ***C22C 9/10*** | (2006.01) |

(56) References Cited

U.S. PATENT DOCUMENTS

| | | | | |
|---|---|---|---|---|
| 2008/0190524 | A1* | 8/2008 | Gao et al. | 148/682 |
| 2009/0202861 | A1 | 8/2009 | Mihara et al. | |
| 2010/0310413 | A1* | 12/2010 | Hirose et al. | 420/473 |

FOREIGN PATENT DOCUMENTS

| | | | |
|---|---|---|---|
| JP | 11-256256 | A | 9/1999 |
| JP | 2004-269962 | A | 9/2004 |
| JP | 2006-283059 | A | 10/2006 |
| JP | 2007-070651 | A | 3/2007 |
| JP | 2008-095186 | A | 4/2008 |
| JP | 2009-263784 | A | 11/2009 |
| WO | WO2009/104615 | * | 8/2009 |

OTHER PUBLICATIONS

Extended European Search Report issued in corresponding European Patent Application No. EP 10854423.0, dated Jun. 17, 2015.

* cited by examiner

CU-NI-SI-BASED COPPER ALLOY PLATE HAVING EXCELLENT DEEP DRAWING WORKABILITY AND METHOD OF MANUFACTURING THE SAME

TECHNICAL FIELD

The present invention relates to a Cu—Ni—Si-based copper alloy plate which has balanced deep drawing workability, solder resistance to heat separation and spring bending elastic limit, in particular, has an excellent deep drawing workability, and is suitable for use in electrical and electronic members, and a method of manufacturing the same.

BACKGROUND ART

Following a recent trend of a decrease in the weight, thickness, and length of electronic devices, efforts have been made to reduce the size and thickness of terminals, connectors, and the like, and there has been a demand for strength and bending workability. As a result, instead of solid solution strengthening-type copper alloys, such as phosphor bronze or brass of the related art, the need for precipitation strengthening-type copper alloys, such as Corson (Cu—Ni—Si-based) alloy, beryllium copper or copper-titanium alloy, is increasing.

Among the precipitation strengthening-type copper alloys, Corson alloy is an alloy having a solid solubility limit of a nickel silicide compound with respect to copper which significantly varies depending on temperature, and is a kind of precipitation strengthening-type alloy which is cured through quenching and tempering. Corson alloy also has favorable heat resistance or high-temperature strength, has excellently balanced strength and electrical conductivity, has thus far been widely used in a variety of conduction springs, electric cables for high tensile strength, and the like, and, in recent years, has been in increasing use for electronic components, such as terminals and connectors.

Generally, strength and bending workability are conflicting properties, even in Corson alloy, studies have thus far been conducted in order to improve bending workability while maintaining a high strength, and efforts have been widely made in order to improve bending workability by adjusting manufacturing processes, and individually or mutually controlling crystal grain diameter, the number and shape of precipitates, and crystal texture.

In addition, in order to use Corson alloy in a predetermined shape in a variety of electronic components under severe environments, there is a demand for feasible workability, particularly, favorable deep drawing workability and solder resistance to heat separation during use at a high temperature.

PTL 1 discloses a Cu—Ni—Si-based alloy for electronic components which contains 1.0 mass % to 4.0 mass % of Ni, and Si at a concentration of ⅙ to ¼ of that of Ni, has a frequency of twin boundaries (Σ3 boundaries) in the all crystal grain boundaries of 15% to 60%, and has excellently balanced strength and bending workability.

PTL 2 discloses a copper-based precipitation-type alloy plate material for contact materials in which the maximum value of the differences among three tensile strengths of a tensile strength in the rolling direction, a tensile strength in a direction that forms an angle of 45° with the rolling direction, and a tensile strength in a direction that forms an angle of 90° with the rolling direction is 100 MPa or less, and which contains 2 mass % to 4 mass % of Ni, 0.4 mass % to 1 mass % of Si, and, if necessary, an appropriate amount of at least one selected from a group consisting of Mg, Sn, Zn and Cr with a remainder of copper and inevitable impurities. The copper-based precipitation-type alloy plate material for contact materials is manufactured by carrying out an aging heat treatment and then cold rolling at a percentage reduction in thickness of 30% or less on a copper alloy plate material which has been subjected to a solution treatment, and improves the operability of multifunction switches used in electronic devices and the like.

PTL 3 discloses a Corson (Cu—Ni—Si-based) copper alloy plate which has a proof stress of 700 N/mm$^2$ or more, an electric conductivity of 35% IACS or more, and excellent bending workability. This copper alloy plate includes Ni: 2.5% (mass %, the same shall apply hereinafter) to less than 6.0% and Si: 0.5% to less than 1.5% so as to make a mass ratio Ni/Si of Ni to Si in a range of 4 to 5, and, furthermore, Sn: 0.01% to less than 4%, with a remainder of Cu and inevitable impurities, has a crystal texture in which the average crystal grain diameter is 10 μm or less, and the fraction of a cube orientation {001}<100> is 50% or more in a measurement result obtained through SEM-EBSP, and is manufactured by obtaining a solution recrystallization structure through continuous annealing, then, carrying out cold rolling at a working rate of 20% or less and an aging treatment at 400° C. to 600° C. for one hour to eight hours, subsequently, carrying out final cold rolling at a working rate of 1% to 20%, and then carrying out short-time annealing at 400° C. to 550° C. for 30 seconds or less.

CITATION LIST

[PTL 1] Japanese Patent Application Laid-Open Publication No. 2009-263784
[PTL 2] Japanese Patent Application Laid-Open Publication No. 2008-95186
[PTL 3] Japanese Patent Application Laid-Open Publication No. 2006-283059

SUMMARY OF INVENTION

Technical Problem

It was often observed that Cu—Ni—Si-based Corson alloy of the related art had insufficient deep drawing workability, had poorly balanced deep drawing workability, solder resistance to heat separation, and spring bending elastic limit, and caused problems in applications as a material of electronic components which are exposed to severe operation environments at a high temperature with large vibrations for a long period of time.

The invention has been made in consideration of the above circumstances, and provides a Cu—Ni—Si-based copper alloy plate which has balanced characteristics of deep drawing workability, solder resistance to heat separation and spring bending elastic limit, particularly has an excellent deep drawing workability, and is used in electrical and electronic members, and a method of manufacturing the same.

Solution to Problem

As a result of thorough studies, the present inventors found that, in a Cu—Ni—Si-based copper alloy containing 1.0 mass % to 3.0 mass % of Ni, 0.2 mass % to 0.8 mass % of Sn, 0.3 mass % to 1.5 mass % of Zn, 0.001 mass % to 0.2 mass % of Mg, and Si at a concentration of ⅙ to ¼ of the mass % concentration of Ni with a remainder of Cu and inevitable impurities, in which the average value of the aspect ratios (the minor axis of crystal grains/the major axis of crystal grains) of each crystal grains in an alloy structure is 0.4 to 0.6, the average value of GOS in the all crystal grains, which is measured through an EBSD method using a scanning electron microscope equipped with an electron backscatter diffraction image system, is 1.2° to 1.5°, in which the boundary for which the orientation difference between adjacent pixels is 5° or more as a crystal grain boundary, by measuring orientations of all pixels in the measurement area range, and the ratio (Lσ/L) of the total special grain boundary length Lσ of special grain boundaries to the total grain boundary length L of crystal grain boundaries is 60% to 70%, the spring bending elastic limit becomes 450 N/mm$^2$ to 600 N/mm$^2$, the solder resistance to heat separation is favorable and deep drawing workability is excellent at 150° C. C for 1000 hours.

Furthermore, it was also found that the average value of the aspect ratio (the minor axis of crystal grains/the major axis of crystal grains) of each crystal grains has an influence mainly on the solder resistance to heat separation at 150° C. for 1000 hours, the average value of GOS in the all crystal grains has an influence mainly on the spring bending elastic limit, and the ratio (Lσ/L) of the total special grain boundary length Lσ of special grain boundaries has an influence mainly on the deep drawing workability.

In addition, it was also found that the average value of the aspect ratio (the minor axis of crystal grains/the major axis of crystal grains) of each crystal grains is basically dependent on the working rate of the final cold rolling in the manufacturing process, the average value of GOS in the all crystal grains is basically dependent on the tensile force in a copper alloy plate in a furnace during continuous low-temperature annealing in the manufacturing process, and the ratio (Lσ/L) of the total special grain boundary length Lσ of special grain boundaries is basically dependent on the floating distance of the copper alloy plate in the furnace during continuous low-temperature annealing in the manufacturing process.

The invention has been made based on the above findings, and the Cu—Ni—Si-based copper alloy of the invention contains 1.0 mass % to 3.0 mass % of Ni, and Si at a concentration of ⅙ to ¼ of the mass % concentration of Ni with a remainder of Cu and inevitable impurities, in which the average value of the aspect ratio (the minor axis of crystal grains/the major axis of crystal grains) of each crystal grains in an alloy structure is 0.4 to 0.6, the average value of GOS in the all crystal grains, which is measured through an EBSD method using a scanning electron microscope equipped with an electron backscatter diffraction image system, is 1.2° to 1.5°, the ratio (Lσ/L) of the total special grain boundary length Lσ of special grain boundaries to the total grain boundary length L of crystal grain boundaries is 60% to 70%, the spring bending elastic limit becomes 450 N/mm$^2$ to 600 N/mm$^2$, the solder resistance to heat separation is favorable and deep drawing workability is excellent at 150° C. for 1000 hours.

When undergoing an appropriate thermal treatment, Ni and Si form fine particles of an intermetallic compound mainly including $Ni_2Si$. As a result, the strength of the alloy significantly increases, and the electrical conductivity also increases at the same time.

Ni is added in a range of 1.0 mass % to 3.0 mass % and preferably 1.5 mass % to 2.5 mass %. When the amount of Ni is less than 1.0 mass %, a sufficient strength cannot be obtained. When the amount of Ni exceeds 3.0 mass %, cracking occurs during hot rolling.

The concentration of added Si (mass %) is set to ⅙ to ¼ of the concentration of added Ni (mass %). When the concentration of added Si is smaller than ⅙ of the concentration of added Ni, the strength decreases, and when the concentration of added Si is larger than ¼ of the concentration of added Ni, Si does not contribute to the strength, and excess Si degrades the conductive properties.

When the average value of the aspect ratio (the minor axis of crystal grains/the major axis of crystal grains) of each crystal grains is less than 0.4 or exceeds 0.6, the sold resistance to heat separation at 150° C. for 1000 hours degrades.

When the average value of GOS in the all crystal grains is less than 1.2° or exceeds 1.5°, the spring bending elastic limit degrades.

When the ratio (Lσ/L) of the total special grain boundary length Lσ of special grain boundaries is less than 60% or exceeds 70%, the deep drawing workability degrades.

Sn and Zn have an action of improving strength and heat resistance, furthermore, Sn has an action of improving the stress relaxation resistance characteristic, and Zn has an action of improving the heat resistance of a solder junction. Sn is added in a range of 0.2 mass % to 0.8 mass %, and Zn is added in a range of 0.3 mass % to 1.5 mass %. When the amounts of the added elements are below the range, desired effects cannot be obtained, and, when the amounts of the elements added are above the range, the conductive properties degrade.

Mg has an effect of improving the stress relaxation characteristic and hot workability; however, when the amount of Mg exceeds 0.2 mass %, castability (degradation of the qualities of a casting surface), hot workability and plating resistance to heat separation.

In addition, the Cu—Ni—Si-based copper alloy of the invention further contains one or two of Fe: 0.007 mass % to 0.25 mass %, P: 0.001 mass % to 0.2 mass %, C: 0.0001 mass % to 0.001 mass %, Cr: 0.001 mass % to 0.3 mass %, and Zr: 0.001 mass % to 0.3 mass %.

Fe has an action of increasing the reliability of connectors through an effect of improving hot rollability (an effect of suppressing occurrence of surface cracking or edge cracking), an effect of miniaturizing the compound precipitation of Ni and Si so as to improve the heat-resistant adhesiveness of plates, and the like; however, when the content thereof is less than 0.007%, the above action cannot obtain desired effects, on the other hand, when the content thereof exceeds 0.25%, the hot rollability effect is saturated, conversely, a tendency for hot rollability to degrade appears, and the conductive properties are also adversely influenced. Therefore, the content thereof is specified to be 0.007% to 0.25%.

P has an action of suppressing degradation of spring properties, which is caused by a bending work, so as to improve the installation and uninstallation characteristic of connectors obtained through a molding work and an action of improving the migration-resisting characteristic; however, when the content thereof is less than 0.001%, desired effects cannot be obtained, on the other hand, when the content thereof exceeds 0.2%, the solder resistance to heat separation is significantly impaired. Therefore, the content thereof is specified to be 0.001% to 0.2%.

C has an action of improving punching workability and, furthermore, an action of miniaturizing a compound of Ni and Si so as to improve the strength of an alloy; however, when the content thereof is less than 0.0001%, desired effects cannot be obtained, on the other hand, when C is included at more than 0.001%, the hot workability is adversely influenced, which is not preferable. Therefore, the content of C is specified to be 0.0001% to 0.001%.

Cr and Zr have a strong affinity to C so as to make it easy for a Cu alloy to contain C, and have an action of further miniaturizing a compound of Ni and Si so as to improve the strength of an alloy and an action of being precipitated so as to further improve the strength; however, even when the content of one or two of Cr and Zr is less than 0.001%, the strength-improving effect of the alloy cannot be obtained, on the other hand, when one or two of Cr and Zr are included at more than 0.3%, large precipitates of Cr and/or Zr are generated such that platability deteriorates, punching workability also deteriorates, and, furthermore, hot workability is impaired, which is not preferable. Therefore, the content of one or two of Cr and Zr is specified to be 0.001% to 0.3%.

In addition, the method of manufacturing a Cu—Ni—Si-based copper alloy plate of the invention is the method of manufacturing a copper alloy plate of the invention, in which, when a copper alloy plate is manufactured using a process including hot rolling, cold rolling, a solution treatment, an aging treatment, final cold rolling, and low-temperature annealing in this order, the working rate during the final cold rolling is set to 10% to 30%, the tensile force applied to the copper alloy plate in a furnace during the continuous low-temperature annealing is set to 300 $N/mm^2$ to 900 $N/mm^2$, and the floating distance of the copper alloy plate in the furnace during the continuous low-temperature annealing is set to 10 mm to 20 mm.

When the working rate during the final cold rolling is less than 10% or exceeds 30%, the average value of the aspect ratio (the minor axis of crystal grains/the major axis of crystal grains) of each crystal grains is not within a range of 0.4 to 0.6.

When the in-furnace tensile force, which is applied to the copper alloy plate during the continuous low-temperature annealing, is less than 300 $N/mm^2$ or exceeds 900 $N/mm^2$, the average value of GOS in the all crystal grains is not within a range of 1.2° to 1.5°.

When the in-furnace floating distance of the copper alloy plate during the continuous low-temperature annealing is less than 10 mm or exceeds 20 mm, the ratio ($L\sigma/L$) of the total special grain boundary length $L\sigma$ of special grain boundaries to the total grain boundary length L of crystal grain boundaries is not within a range of 60% to 70%.

Advantageous Effects of Invention

The present invention has been made in consideration of the above circumstances, and provides a Cu—Ni—Si-based copper alloy which has balanced deep drawing workability, plating solder resistance to heat separation and spring bending elastic limit, particularly has an excellent deep drawing workability, and is suitable for use in electrical and electronic members, and a method of manufacturing the same.

DESCRIPTION OF EMBODIMENTS

Figure 1:
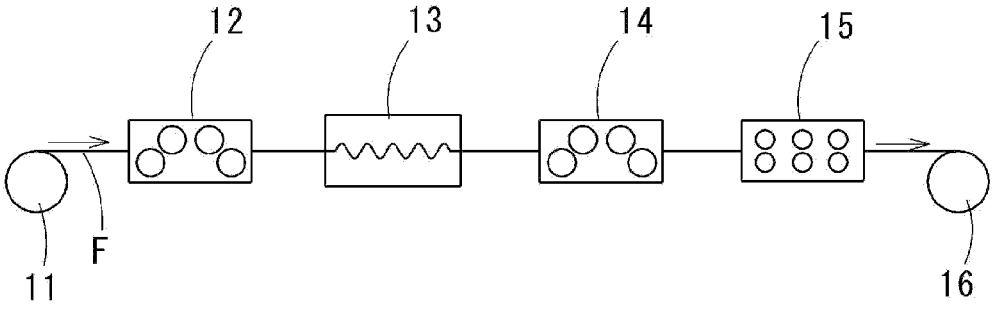
FIG. 1 is a schematic view showing an example of a continuous low-temperature annealing facility used in the method of manufacturing a Cu—Ni—Si-based copper alloy of the invention.

Hereinafter, embodiments of the invention will be described.

[The Component Composition of a Copper Alloy Strip]

The material of the copper alloy strip of the invention has a composition containing, by mass %, 1.0 mass % to 3.0 mass % of Ni, and Si at a concentration of ⅙ to ¼ of the mass % concentration of Ni with a remainder of Cu and inevitable impurities.

When undergoing an appropriate thermal treatment, Ni and Si form fine particles of an intermetallic compound mainly including $Ni_2Si$. As a result, the strength of the alloy significantly increases, and the electrical conductivity also increases at the same time.

Ni is added in a range of 1.0 mass % to 3.0 mass % and preferably 1.5 mass % to 2.5 mass %. When the amount of Ni is less than 1.0 mass %, a sufficient strength cannot be obtained. When the amount of Ni exceeds 3.0 mass %, cracking occurs during hot rolling.

The concentration of added Si (mass %) is set to ⅙ to ¼ of the concentration of added Ni (mass %). When the concentration of added Si is smaller than ⅙ of the concentration of added Ni, the strength decreases, and when the concentration of added Si is larger than ¼ of the concentration of added Ni, Si does not contribute to the strength, and excess Si degrades the conductive properties.

In addition, the copper alloy may further contain 0.2 mass % to 0.8 mass % of Sn and 0.3 mass % to 1.5 mass % of Zn with respect to the above basic composition.

Sn and Zn have an action of improving strength and heat resistance, furthermore, Sn has an action of improving the stress relaxation resistance characteristic, and Zn has an action of improving the heat resistance of a solder junction. Sn is added in a range of 0.2 mass % to 0.8 mass %, and Zn is added in a range of 0.3 mass % to 1.5 mass %. When the amounts of the elements added are below the range, desired effects cannot be obtained, and, when the amounts of the elements added are above the range, the conductive properties degrade.

In addition, the copper alloy may further contains 0.001 mass % to 0.2 mass % of Mg with respect to the above basic composition. Mg has an effect of improving the stress relaxation characteristic and hot workability, and is added in a range of 0.001 mass % to 0.2 mass %. When more than 0.2 mass % of Mg is added, castability (degradation of the qualities of a casting surface), hot workability and plating resistance to heat separation degrade.

In addition, the copper alloy may further contain one or two of Fe: 0.007 mass % to 0.25 mass %, P: 0.001 mass % to 0.2 mass %, C: 0.0001 mass % to 0.001 mass %, Cr: 0.001 mass % to 0.3 mass %, and Zr: 0.001 mass % to 0.3 mass % with respect to the basic composition.

Fe has an action of increasing the reliability of connectors through an effect of improving hot rollability (an effect of suppressing occurrence of surface cracking or edge cracking), an effect of miniaturizing the compound precipitation of Ni and Si so as to improve the heat-resistant adhesiveness of plates, and the like; however, when the content thereof is less than 0.007%, the above action cannot obtain desired effects, on the other hand, when the content thereof exceeds 0.25%, the hot rollability effect is saturated, conversely, a tendency for hot rollability to degrade appears, and the conductive properties are also adversely influenced. Therefore, the content thereof is specified to be 0.007% to 0.25%.

P has an action of suppressing degradation of spring properties, which is caused by a bending work, so as to improve the installation and uninstallation characteristics of connectors obtained through a molding work and an action of improving the migration-resisting characteristic; however, when the content thereof is less than 0.001%, desired effects cannot be obtained, on the other hand, when the content thereof exceeds 0.2%, the solder resistance to heat separation is significantly impaired. Therefore, the content thereof is specified to be 0.001% to 0.2%.

C has an action of improving punching workability and, furthermore, an action of miniaturizing a compound of Ni and Si so as to improve the strength of an alloy; however, when the content thereof is less than 0.0001%, desired effects cannot be obtained, on the other hand, when C is included at more than 0.001%, the hot workability is adversely influenced, which is not preferable. Therefore, the content of C is specified to be 0.0001% to 0.001%.

Cr and Zr have a strong affinity to C so as to make it easy for a Cu alloy to contain C, and have an action of further miniaturizing a compound of Ni and Si so as to improve the strength of an alloy and an action of being precipitated so as to further improve the strength; however, even when the content of one or two of Cr and Zr is less than 0.001%, the strength-improving effect of the alloy cannot be obtained, on the other hand, when one or two of Cr and Zr are included at more than 0.3%, large precipitates of Cr and/or Zr are generated such that platability deteriorates, punching workability also deteriorates, and, furthermore, hot workability is impaired, which is not preferable. Therefore, the content of one or two of Cr and Zr is specified to be 0.001% to 0.3%.

In addition, the Cu—Ni—Si-based copper alloy plate has an average value of the aspect ratio (the minor axis of crystal grains/the major axis of crystal grains) of each crystal grains in the alloy structure of 0.4 to 0.6, an average value of GOS in the all crystal grains, which is measured through an EBSD method using a scanning electron microscope equipped with an electron backscatter diffraction image system, of 1.2° to 1.5°, a ratio (Lσ/L) of the total special grain boundary length Lσ of special grain boundaries to the total grain boundary length L of crystal grain boundaries of 60% to 70%, a spring bending elastic limit of 450 N/mm$^2$ to 600 N/mm$^2$, favorable solder resistance to heat separation at 150° C. for 1000 hours is favorable, and excellent deep drawing workability.

[Aspect Ratio, GOS and Lσ/L]

The average value of the aspect ratio (the minor axis of crystal grains/the major axis of crystal grains) of each crystal grains in the alloy structure was obtained in the following manner.

As a pretreatment, a 10 mm×10 mm specimen was immersed in 10% sulfuric acid for ten minutes, then, was washed using water, water was sprinkled through air blowing, and then a surface treatment was carried out on the water-scattered specimen using a flat milling (ion milling) apparatus manufactured by Hitachi High-Technologies Corporation at an acceleration voltage of 5 kV and an incidence angle of 5° for one hour of exposure time.

Next, the surface of the specimen was observed using a scanning electron microscope S-3400N manufactured by Hitachi High-Technologies Corporation, which was equipped with an EBSD system manufactured by TexSEM Laboratories, Inc. The observation conditions were an acceleration voltage of 25 kV, a measurement area (in the rolling direction) of 150 μm×150 μm.

Next, the orientations of all pixels in the measurement area were measured at a step size of 0.5 μm, in a case in which a boundary for which the orientation difference between pixels was 5° or more was defined as the crystal grain boundary, and a group of two or more pixels surrounded by the crystal grain boundaries was considered as a crystal grain, the length of the respective crystal grains in the long axis direction was indicated by a, the length in the short axis direction was indicated by b, a value obtained by dividing b by a was defined as the aspect ratio, the aspect ratios of all crystal grains in the measurement area were obtained, and the average value was computed.

When the average value of the aspect ratio (the minor axis of crystal grains/the major axis of crystal grains) of crystal grains is less than 0.4 or exceeds 0.6, the solder resistance to heat separation at 150° C. for 1000 hours degrades.

The average value of GOS in the all crystal grains, which is measured through an EBSD method using a scanning electron microscope equipped with an electron backscatter diffraction image system, was obtained in the following manner.

As a pretreatment, a 10 mm×10 mm specimen was immersed in 10% sulfuric acid for ten minutes, then, was washed using water, water was scattered through air blowing, and then a surface treatment was carried out on the water-scattered specimen using a flat milling (ion milling) apparatus manufactured by Hitachi High-Technologies Corporation at an acceleration voltage of 5 kV and an incidence angle of 5° for one hour of exposure time.

Next, the surface of the specimen was observed using a scanning electron microscope S-3400N manufactured by Hitachi High-Technologies Corporation, which was equipped with an EBSD system manufactured by TexSEM Laboratories, Inc. The observation conditions were an acceleration voltage of 25 kV, a measurement area of 150 μm×150 μm.

From the observation results, the average value of the average orientation differences between all pixels in a crystal grain throughout all crystal grains was obtained under the following conditions.

The orientations of all pixels in the measurement area range were measured at a step size of 0.5 μm, and a boundary for which the orientation difference between adjacent pixels was 5° or more was defined as the crystal grain boundary.

Next, throughout all of the respective crystal grains surrounded by crystal grain boundaries, the average value of the orientation differences between all pixels in a crystal grain (GOS: Grain Orientation Spread) was computed using the formula (1), the average value of all values was used as the average orientation difference between all pixels in a crystal grain throughout all crystal grains, that is, the average value of GOS throughout all crystal grains. Meanwhile, a connection of two or more pixels was considered as a crystal grain.

[Formula 1]

$$GOS = \frac{\sum_{i,j=1}^{n} \alpha_{ij(i \neq j)}}{n(n-1)} \quad (1)$$

In the above formula, i and j represent the numbers of pixels in a crystal grain.

n represents the number of pixels in a crystal grain.

$\alpha_{ij}$ represents the orientation difference of a pixel i and j.

When the average value of GOS in all crystal grains is less than 1.2° or exceeds 1.5°, the spring bending elastic limit degrades.

The ratio (Lσ/L) of the total special grain boundary length Lσ of special grain boundaries to the total grain boundary length L of crystal grain boundaries, which was measured through an EBSD method using a scanning electron microscope equipped with an electron backscatter diffraction image system, was obtained in the following manner. The special grain boundary is a crystal grain boundary (corresponding grain boundary) having a Σ value, which is crystallographically defined based on the CSL theory (Krongerg et. al.: Trans. Met. Soc. AIME, 185, 501 (1949)), of $3 \leq \Sigma \leq 29$, and is defined as a crystal grain boundary in which the intrinsic corresponding position lattice orientation defect $D_q$ in the grain boundary satisfies $D_q \leq 15°/\Sigma^{1/2}$ (D. G. Brandon: Acta. Metallurgica. Vol. 14, p 1479, 1966).

As a pretreatment, a 10 mm×10 mm specimen was immersed in 10% sulfuric acid for ten minutes, then, was washed using water, water was scattered through air blowing, and then a surface treatment was carried out on the water-scattered specimen using a flat milling (ion milling) apparatus manufactured by Hitachi High-Technologies Corporation at an acceleration voltage of 5 kV and an incidence angle of 5° for one hour of exposure time.

Next, the surface of the specimen was observed using a scanning electron microscope S-3400N manufactured by Hitachi High-Technologies Corporation, which was equipped with an EBSD system manufactured by TexSEM Laboratories, Inc. The observation conditions were an acceleration voltage of 25 kV, a measurement area of 150 μm×150 μm.

The orientations of all pixels in the measurement area range were measured at a step size of 0.5 μm, and a boundary for which the orientation difference between adjacent pixels was 5° or more was defined as the crystal grain boundary.

Next, the all grain boundary length L of crystal grain boundaries in the measurement area was measured, locations at which the interface between adjacent crystal grains constitutes the special grain boundary are determined, the grain boundary length ratio Lσ/L between the total special grain boundary length Lσ of the special grain boundaries and the measured total grain boundary length L of crystal grain boundaries was obtained, and used as the special grain boundary length ratio.

When the ratio (Lσ/L) of the total special grain boundary length Lσ of the special grain boundaries is less than 60% or exceeds 70%, the deep drawing workability degrades.

[Manufacturing Method]

In the method of manufacturing a Cu—Ni—Si-based copper alloy of the invention, when a copper alloy plate is manufactured using a process including hot rolling, cold rolling, a solution treatment, an aging treatment, final cold rolling, and low-temperature annealing in this order, the working rate during the final cold rolling is set to 10% to 30%, the tensile force applied to the copper alloy plate in a furnace during the continuous low-temperature annealing is set to 300 N/mm$^2$ to 900 N/mm$^2$, and the floating distance of the copper alloy plate in the furnace during the continuous low-temperature annealing is set to 10 mm to 20 mm.

When the working rate during the final cold rolling is less than 10% or exceeds 30%, the average value of the aspect ratio (the minor axis of crystal grains/the major axis of crystal grains) of each crystal grains is not within a range of 0.4 to 0.6, and a decrease in the solder resistance to heat separation is caused.

When the in-furnace tensile force, which is applied to the copper alloy plate during the continuous low-temperature annealing, is less than 300 N/mm$^2$ or exceeds 900 N/mm$^2$, the average value of GOS in the all crystal grains is not within a range of 1.2° to 1.5°, and a decrease in the spring bending elastic limit is caused.

When the in-furnace floating distance of the copper alloy plate during the continuous low-temperature annealing is less than 10 mm or exceeds 20 mm, the ratio (Lσ/L) of the total special grain boundary length Lσ of special grain boundaries to the total grain boundary length L of crystal grain boundaries is not within a range of 60% to 70%, and a decrease in the deep drawing workability is caused.

FIG. 1 shows an example of a continuous low-temperature annealing facility used in the manufacturing method of the invention. A copper alloy plate F wound in a pay-off reel 11, which has been subjected to final cold rolling, is loaded by a predetermined tensile force at a tensile force controlling apparatus 12 and a tensile force controlling apparatus 14, is subjected to low-temperature annealing at a predetermined temperature and a predetermined time in a transverse annealing furnace 13, passes through a grinding and pickling apparatus 15, and is wound on a tension reel 16.

Figure 2:
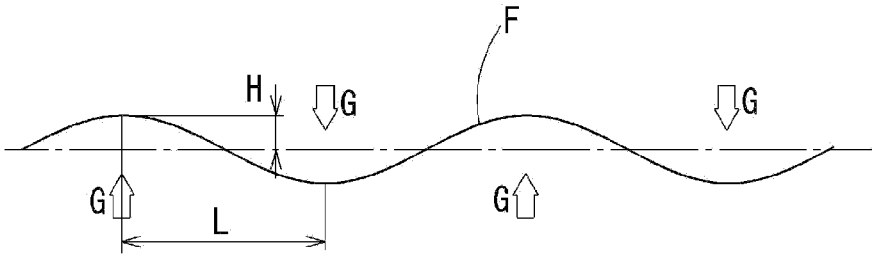
FIG. 2 is a schematic view explaining the floating distance of a copper plate in a continuous low-temperature annealing furnace used in the method of manufacturing a Cu—Ni—Si-based copper alloy of the invention.

As shown in FIG. 2, the in-furnace floating distance of the copper alloy plate F during the continuous low-temperature annealing in the invention is the crest value of the copper alloy plate F moving in a wave in the furnace due to hot air G. In FIG. 2, the copper alloy plate F moves in a wave having a span L, and the height from the center of the wave is considered as the floating distance H. The floating distance H can be controlled using a tensile force applied to the copper alloy plate F using the tensile force controlling apparatuses 12 and 13 and the ejection amount of the hot air G blown to the copper alloy plate F in the annealing furnace 13.

The following method can be considered as an example of the specific manufacturing method.

Firstly, materials are prepared so as to produce the Cu—Ni—Si-based copper alloy plate of the invention, and melting and casting is carried out using a low-frequency melting furnace having a reducing atmosphere so as to obtain a copper alloy ingot. Next, the copper alloy ingot is heated at 900° C. to 980° C., then hot rolling is carried out so as to produce a hot-rolled plate having an appropriate thickness, the hot-rolled plate is cooled using water, and then both surfaces are faced to an appropriate extent. Next, cold rolling is carried out at a percentage reduction in thickness of 60% to 90%, a cold-rolled plate having an appropriate thickness is manufactured, and then continuous annealing is carried out under conditions in which the cold-rolled plate is held at 710° C. to 750° C. for 7 seconds to 15 seconds. Next, the copper plate which has been subjected to the continuous annealing treatment is pickled, the surface is grinded, then, cold rolling is carried out at a percentage reduction in thickness of 60% to 90%, and a cold-rolled thin plate having an appropriate thickness is manufactured. Next, the cold-rolled thin plate is held at 710° C. to 780° C. for 7 seconds to 15 seconds, then, is quenched so as to carry out a solution treatment, then, is held at 430° C. to 470° C. for three hours so as to carry out an aging treatment, then, a pickling treatment is carried out, furthermore, final cold rolling is carried out at a working rate of 10% to 30%, and low-temperature annealing is carried out with a tensile force applied to the copper alloy plate in the furnace during the continuous low-temperature annealing set to 300 N/mm$^2$ to 900 N/mm$^2$ and a floating distance of the copper alloy plate in the furnace during the continuous low-temperature annealing set to 10 mm to 20 mm.

Examples

Materials were prepared so as to produce the components shown in Table 1, the components were melted using a low-frequency melting furnace having a reducing atmosphere, and then cast so as to manufacture a copper alloy ingot having dimensions of a thickness of 80 mm, a width of 200 mm, and a length of 800 mm. The copper alloy ingot was heated at 900° C. to 980° C., then hot rolling was carried out so as to produce a hot-rolled plate having a thickness of 11 mm, the hot-rolled plate was cooled using water, and then both surfaces were faced to be 0.5 mm. Next, cold rolling was carried out at a percentage reduction in thickness of 87% so as to manufacture a cold-rolled plate having a thickness of 1.3 mm, then, continuous annealing was carried out under conditions in which the cold-rolled plate was held at 710° C. to 750° C. for 7 seconds to 15 seconds, then, the copper plate was pickled, the surface was ground, and, furthermore, cold rolling was carried out at a percentage reduction in thickness of 77% so as to manufacture a cold-rolled thin plate having a thickness of 0.3 mm.

The cold-rolled plate was held at 710° C. to 780° C. for 7 seconds to 15 seconds, then, was quenched so as to carry out a solution treatment, subsequently, was held at 430° C. to 470° C. for three hours so as to carry out an aging treatment, a pickling treatment was carried out, furthermore, and final cold rolling and continuous low-temperature annealing was carried out under the conditions shown in Table 1, thereby manufacturing a copper alloy thin plate. In Table 1, the threading state of the copper alloy plate in the low-temperature annealing furnace is a waveform, the span L of the wave shown in FIG. 2 is 30 mm to 70 mm, and indicates the floating distance H at this time.

of special grain boundaries to the total grain boundary length L of crystal grain boundaries, deep drawing workability, spring bending elastic limits, and sold heat-resistance detachability were measured.

The average value of the aspect ratio was obtained in the following manner.

As a pretreatment, a 10 mm×10 mm specimen was immersed in 10% sulfuric acid for ten minutes, then, was washed using water, water was scattered through air blowing, and then a surface treatment was carried out on the water-scattered specimen using a flat milling (ion milling) apparatus manufactured by Hitachi High-Technologies Corporation at an acceleration voltage of 5 kV and an incidence angle of 5° for one hour of exposure time.

Next, the surface of the specimen was observed using a scanning electron microscope S-3400N manufactured by Hitachi High-Technologies Corporation, which was equipped with an EBSD system manufactured by TexSEM Laboratories, Inc. The observation conditions were an acceleration voltage of 25 kV, a measurement area (in the rolling direction) of 150 μm×150 μm.

Next, the orientations of all pixels in the measurement area were measured at a step size of 0.5 μm, in a case in which a boundary for which the orientation difference between pixels was 5° or more was defined as the grain boundary, and a group of two or more pixels surrounded by the grain boundaries was considered as a crystal grain, the length of the respective crystal grains in the long axis

TABLE 1

| | Component composition (mass %) | | | | | | | | | | Working rate during final rolling | Low-temperature annealing | | | |
|---|---|---|---|---|---|---|---|---|---|---|---|---|---|---|---|
| | Ni | Si | Sn | Zn | Mg | Fe | P | C | Cr | Zr | (%) | Temperature (°) | Time (S) | Tensile strength in furnace (N/mm$^2$) | Floating distance (mm) |
| Example 1 | 2.0 | 0.5 | 0.6 | 1.0 | 0.005 | | | | | | 12 | 380 | 30 | 600 | 18 |
| Example 2 | 2.0 | 0.4 | 0.4 | 0.9 | 0.007 | 0.03 | 0.01 | | | | 15 | 350 | 50 | 300 | 20 |
| Example 3 | 1.5 | 0.3 | 0.5 | 0.5 | 0.006 | | | | | | 10 | 300 | 60 | 700 | 12 |
| Example 4 | 1.5 | 0.2 | 0.8 | 0.8 | 0.01 | | | 0.0004 | | | 24 | 350 | 40 | 500 | 14 |
| Example 5 | 2.5 | 0.5 | 0.6 | 0.5 | 0.06 | | | | 0.02 | 0.019 | 21 | 400 | 20 | 900 | 10 |
| Example 6 | 2.5 | 0.6 | 0.2 | 1.2 | 0.1 | | | 0.0006 | 0.007 | 0.007 | 18 | 320 | 50 | 500 | 16 |
| Example 7 | 1.0 | 0.2 | 0.8 | 0.7 | 0.008 | | | | | | 30 | 350 | 40 | 700 | 12 |
| Example 8 | 1.1 | 0.2 | 0.6 | 1.5 | 0.002 | 0.18 | 0.07 | | | | 15 | 380 | 30 | 400 | 16 |
| Example 9 | 3.0 | 0.6 | 0.4 | 0.6 | 0.19 | 0.07 | 0.02 | | | | 12 | 400 | 20 | 800 | 18 |
| Example 10 | 3.0 | 0.7 | 0.5 | 0.3 | 0.04 | | | | | | 18 | 350 | 30 | 500 | 14 |
| Comparative example 1 | 2.0 | 0.5 | 0.5 | 1.0 | 0.004 | | | | | | 40 | 350 | 40 | 1200 | 0 |
| Comparative example 2 | 2.5 | 0.6 | 0.4 | 0.7 | | | | | | | 8 | 350 | 40 | 1500 | 0 |
| Comparative example 3 | 1.5 | 0.3 | 0.4 | 1.0 | 0.003 | | | | | | 50 | 380 | 30 | 1500 | 0 |
| Comparative example 4 | 2.2 | 0.6 | 1.2 | 0.1 | 0.0005 | | | | | | 10 | 380 | 30 | 1200 | 0 |
| Comparative example 5 | 3.5 | 1.0 | 1.0 | 0.5 | | | | | | | 5 | 300 | 60 | 100 | 0 |
| Comparative example 6 | 0.7 | 0.10 | 0.1 | 0.2 | | | | | | | 40 | 300 | 60 | 100 | 0 |
| Comparative example 7 | 2.0 | 0.4 | 1.0 | 2.0 | 0.05 | | | | | | 50 | 400 | 20 | 1200 | 5 |
| Comparative example 8 | 3.4 | 1.2 | 0.1 | 0.2 | | | | | | | 20 | 400 | 20 | 1200 | 5 |
| Comparative example 9 | 4.0 | 1.5 | | | | | | | | | 5 | 350 | 40 | 1500 | 0 |

Next, for the respective obtained specimens, aspect ratios, the average values of GOS throughout all crystal grains, the ratios (Lσ/L) of the total special grain boundary length Lσ direction was indicated by a, the length in the short axis direction was indicated by b, a value obtained by dividing b by a was defined as the aspect ratio, the aspect ratios of all crystal grains in the measurement area were obtained, and the average value was computed.

The average value of GOS in the all crystal grains was obtained in the following manner.

As a pretreatment, a 10 mm×10 mm specimen was immersed in 10% sulfuric acid for ten minutes, then, was washed using water, water was scattered through air blowing, and then a surface treatment was carried out on the water-scattered specimen using a flat milling (ion milling) apparatus manufactured by Hitachi High-Technologies Corporation at an acceleration voltage of 5 kV and an incidence angle of 5° for one hour of exposure time.

Next, the surface of the specimen was observed using a scanning electron microscope S-3400N manufactured by Hitachi High-Technologies Corporation, which was equipped with an EBSD system manufactured by TexSEM Laboratories, Inc. The observation conditions were an acceleration voltage of 25 kV, a measurement area of 150 μm×150 μm.

From the observation results, the average value of the average orientation differences between all pixels in a crystal grain throughout all crystal grains was obtained under the following conditions.

The orientations of all pixels in the measurement area range were measured at a step size of 0.5 μm, and a boundary for which the orientation difference between adjacent pixels was 5° or more was defined as the crystal grain boundary.

Next, throughout all of the respective crystal grains surrounded by crystal grain boundaries, the average value of the orientation differences between all pixels in a crystal grain (GOS: Grain Orientation Spread) was computed using the formula (1), the average value of all values was used as the average orientation difference between all pixels in a crystal grain throughout all crystal grains, that is, the average value of GOS throughout all crystal grains. Meanwhile, a connection of two or more pixels was considered as a crystal grain.

[Formula 2]

$$GOS = \frac{\sum_{i,j-1}^{n} \alpha_{ij(i \neq j)}}{n(n-1)} \quad (1)$$

In the above formula, i and j represent the numbers of pixels in a crystal grain.

n represents the number of pixels in a crystal grain.

$\alpha_{ij}$ represents the orientation difference of a pixel and j.

The ratio (Lσ/L) of the total special grain boundary length Lσ of special grain boundaries to the total grain boundary length L of crystal grain boundaries was obtained in the following manner.

As a pretreatment, a 10 mm×10 mm specimen was immersed in 10% sulfuric acid for ten minutes, then, was washed using water, water was scattered through air blowing, and then a surface treatment was carried out on the water-scattered specimen using a flat milling (ion milling) apparatus manufactured by Hitachi High-Technologies Corporation at an acceleration voltage of 5 kV and an incidence angle of 5° for one hour of exposure time.

Next, the surface of the specimen was observed using a scanning electron microscope S-3400N manufactured by Hitachi High-Technologies Corporation, which was equipped with an EBSD system manufactured by TexSEM Laboratories, Inc. The observation conditions were an acceleration voltage of 25 kV, a measurement area of 150 μm×150 μm.

The orientations of all pixels in the measurement area range were measured at a step size of 0.5 μm, and a boundary for which the orientation difference between adjacent pixels was 5° or more was defined as the crystal grain boundary.

Next, the all grain boundary length L of crystal grain boundaries in the measurement area was measured, locations at which the interface between adjacent crystal grains constitutes the special grain boundary are determined, the grain boundary length ratio Lσ/L between the total special grain boundary length Lσ of the special grain boundaries and the measured total grain boundary length L of crystal grain boundaries was obtained, and used as the special grain boundary length ratio.

Deep drawing workability was obtained in the following manner.

Cups were manufactured using a tester manufactured by Erichsen Gmbh&Co.Kg under conditions of a punch diameter: ϕ10 mm and a lubricant: grease, the appearances were observed, favorable cups were evaluated as O, and cups in which chipping or cracking occurred at the edge portion were evaluated as X.

The spring bending elastic limit was obtained in the following manner.

The amount of permanent deflection was measured using a moment-type test based on JIS-H3130, and Kb0.1 (the surface maximum stress value at a fixed end which corresponds to an amount of permanent deflection of 0.1 mm) at R.T. was computed.

The solder resistance to heat separation was obtained in the following manner.

The respective obtained specimens were cut into a strip shape having a width of 10 mm and a length of 50 mm, and the specimens were immersed in 60% Sn-40% Pb solder at 230° C.±5° C. for 5 seconds. 25% rosin ethanol was used as the flux. These materials were heated at 150° C. for 1000 hours, were bent 90° at the same bending radius as the plate thickness, were made to return to the original angle, and the presence of solder detachment at the bent portions was visually observed.

The measurement results are shown in Table 2.

TABLE 2

| | Average value of GOS (°) | Lσ/L (%) | Average value of aspect ratio | Deep drawing workability | Spring bending elastic limit (N/mm$^2$) | Resistance to heat separation 150° C. × 1000 h |
|---|---|---|---|---|---|---|
| Example 1 | 1.22 | 68.1 | 0.56 | ○ | 537 | ○ |
| Example 2 | 1.36 | 69.4 | 0.53 | ○ | 549 | ○ |
| Example 3 | 1.32 | 63.8 | 0.59 | ○ | 481 | ○ |
| Example 4 | 1.33 | 62.7 | 0.46 | ○ | 487 | ○ |
| Example 5 | 1.49 | 62.2 | 0.48 | ○ | 570 | ○ |
| Example 6 | 1.38 | 66.5 | 0.51 | ○ | 582 | ○ |
| Example 7 | 1.43 | 60.6 | 0.41 | ○ | 453 | ○ |

TABLE 2-continued

| | Average value of GOS (°) | Lσ/L (%) | Average value of aspect ratio | Deep drawing workability | Spring bending elastic limit (N/mm$^2$) | Resistance to heat separation 150° C. × 1000 h |
|---|---|---|---|---|---|---|
| Example 8 | 1.38 | 65.4 | 0.54 | ○ | 467 | ○ |
| Example 9 | 1.45 | 67.8 | 0.57 | ○ | 595 | ○ |
| Example 10 | 1.35 | 64.1 | 0.5 | ○ | 581 | ○ |
| Comparative example 1 | 1.68 | 47.2 | 0.38 | X | 430 | X |
| Comparative example 2 | 1.74 | 45.8 | 0.62 | X | 438 | X |
| Comparative example 3 | 1.76 | 48.6 | 0.35 | X | 407 | X |
| Comparative example 4 | 1.65 | 45.3 | 0.61 | X | 434 | X |
| Comparative example 5 | 1.02 | 44.1 | 0.64 | X | 441 | X |
| Comparative example 6 | 0.96 | 47.0 | 0.37 | X | 398 | X |
| Comparative example 7 | 1.61 | 51.6 | 0.35 | X | 434 | X |
| Comparative example 8 | 1.72 | 53.2 | 0.61 | X | 445 | X |
| Comparative example 9 | 1.86 | 47.7 | 0.65 | X | 437 | X |

It is found from Table 2 that the Cu—Ni—Si-based copper alloy of the invention has balanced deep drawing workability, solder resistance to heat separation and spring bending elastic limit, particularly has an excellent deep drawing workability, and is suitable for use in electronic members which are exposed to severe operation environments at a high temperature with large vibrations for a long period of time.

Thus far, the manufacturing method of the embodiment of the invention has been described, but the invention is not limited to the description, and a variety of modifications can be added within the scope of the purport of the invention.

INDUSTRIAL APPLICABILITY

The invention has balanced deep drawing workability, solder resistance to heat separation and spring bending elastic limit, particularly has an excellent deep drawing workability, and can be applied to use for electrical and electronic members.

REFERENCE SIGNS LIST

11 PAY-OFF REEL
12 TENSLE STRENGTH CONTROLLING APPARATUS
13 TRANSVERSE ANNEALING FURNACE
14 TENSLE STRENGTH CONTROLLING APPARATUS
15 GRINDING AND PICKLING APPARATUS
16 TENSION REEL
F COPPER ALLOY PLATE
G HOT AIR

The invention claimed is:

1. A Cu—Ni—Si-based copper alloy plate comprising:
1.0 mass % to 3.0 mass % of Ni;
0.2 mass % to 0.8 mass % of Sn;
0.3 mass % to 1.5 mass % of Zn;
0.001 mass % to 0.2 mass % of Mg; and
Si at a concentration of ⅙ to ¼ of a mass % concentration of Ni,
with a remainder of Cu and inevitable impurities,
wherein, an average value of aspect ratios (a minor axis of crystal grains/a major axis of crystal grains) of each crystal grains in an alloy structure is 0.4 to 0.6, an average value of GOS in all crystal grains, which is measured through an EBSD method using a scanning electron microscope equipped with an electron back-scatter diffraction image system, is 1.2° to 1.5°, wherein a boundary for which an orientation difference between adjacent pixels is 5° or more as a crystal grain boundary, by measuring orientations of all pixels in a measurement area range; and a ratio (Lσ/L) of a total special grain boundary length Lσ of special grain boundaries to a total grain boundary length L of crystal grain boundaries is 60% to 70%, a spring bending elastic limit becomes 450 N/mm$^2$ to 600 N/mm$^2$, a solder resistance to heat separation is favorable and deep drawing workability is excellent at 150° C. for 1000 hours.

2. The Cu—Ni—Si-based copper alloy plate according to claim 1, further comprising one or two of:
Fe: 0.007 mass % to 0.25 mass %;
P: 0.001 mass % to 0.2 mass %;
C: 0.0001 mass % to 0.001 mass %;
Cr: 0.001 mass % to 0.3 mass %; and
Zr: 0.001 mass % to 0.3 mass %.

3. A method of manufacturing the Cu—Ni—Si-based copper alloy plate according to claim 1,
wherein, when a copper alloy plate is manufactured using a process including hot rolling, cold rolling, a solution treatment, an aging treatment, final cold rolling, and low-temperature annealing in this order, a working rate during the final cold rolling is set to 10% to 30%, the tensile force applied to a copper alloy plate in a furnace during the continuous low-temperature annealing is set to 300 N/mm$^2$ to 900 N/mm$^2$, and a floating distance of the copper alloy plate in the furnace during the continuous low-temperature annealing is set to 10 mm to 20 mm.

* * * * *